US011478400B1

(12) United States Patent
Marton et al.

(10) Patent No.: US 11,478,400 B1
(45) Date of Patent: Oct. 25, 2022

(54) PERCUSSIVE MASSAGE DEVICE WITH SELECTABLE STROKE LENGTH

(71) Applicant: Hyper Ice, Inc., Irvine, CA (US)

(72) Inventors: Robert Marton, Yorba Linda, CA (US); Anthony Katz, Laguna Niguel, CA (US)

(73) Assignee: Hyper Ice, Inc., Irvine, CA (US)

( * ) Notice: Subject to any disclaimer, the term of this patent is extended or adjusted under 35 U.S.C. 154(b) by 349 days.

(21) Appl. No.: 16/864,596

(22) Filed: May 1, 2020

Related U.S. Application Data

(60) Provisional application No. 62/873,731, filed on Jul. 12, 2019.

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/0153* (2013.01); *A61H 2201/0192* (2013.01); *A61H 2201/149* (2013.01)

(58) Field of Classification Search
CPC ..... A61H 23/00–06; A61H 2023/002–045; A61H 2201/0153; A61H 2201/0192; A61H 2201/12–1215; A61H 2201/123; A61H 2201/1246; A61H 2201/1472–149; A61H 2201/1657; A61H 2201/1664; A61H 1/006–008; A61H 19/00–50; F16H 3/54
USPC ..... 601/108; 74/828–830, 834–837, 25, 45, 74/47–50, 55
See application file for complete search history.

(56) References Cited

U.S. PATENT DOCUMENTS

| | | | |
|---|---|---|---|
| 4,088,128 | A | 5/1978 | Mabuchi |
| 4,513,737 | A | 4/1985 | Mabuchi |
| 4,549,535 | A | 10/1985 | Wing |
| 4,726,430 | A | 2/1988 | Hendrikx et al. |
| 4,841,955 | A | 6/1989 | Evans et al. |

(Continued)

FOREIGN PATENT DOCUMENTS

| | | | |
|---|---|---|---|
| KR | 200311328 | Y1 | 5/2003 |
| WO | 2009014727 | A1 | 1/2009 |

OTHER PUBLICATIONS

Rachel [family name unknown], "Jigsaw Massager," Aug. 28, 2007, 7 pages Information available online from http://www.instructables.com/id/Jigsaw-Massager/.

*Primary Examiner* — Valerie L Woodward
*Assistant Examiner* — Paige Kathleen Bugg
(74) *Attorney, Agent, or Firm* — Patterson Intellectual Property Law, P.C.; Jerry Turner Sewell

(57) ABSTRACT

A percussive massage device includes a cylinder extending along a longitudinal axis. A motor shaft that rotates about a central axis perpendicular to the longitudinal axis. A crank coupled to the shaft includes a first pivot offset from the central axis. A pinion gear is coupled to the first pivot. The pinion gear rotates within a ring gear. The pinion gear has a second pivot that rotates about the first pivot. A reciprocation linkage is coupled between the second pivot and a piston that moves longitudinally within the cylinder. An applicator head coupled to a second end of the piston has an end exposed outside the cylinder for application to a person receiving treatment. An actuator selectively rotates the ring gear to cause the applicator head to have a first stroke length and at least a second stroke length.

3 Claims, 15 Drawing Sheets

(56) References Cited

U.S. PATENT DOCUMENTS

| | | | | |
|---|---|---|---|---|
| 5,134,777 | A * | 8/1992 | Meyer | B23D 49/167 30/392 |
| 6,228,042 | B1 | 5/2001 | Dungan | |
| 6,682,496 | B1 | 1/2004 | Pivaroff | |
| 7,658,012 | B2 * | 2/2010 | James | B23Q 11/0035 30/392 |
| 8,826,547 | B2 | 9/2014 | Oberheim | |
| 9,889,066 | B2 | 2/2018 | Danby et al. | |
| 10,702,448 | B2 * | 7/2020 | Wersland | A61H 23/00 |
| 2003/0028134 | A1 * | 2/2003 | Lev | A61H 23/0263 601/111 |
| 2006/0293711 | A1 | 12/2006 | Keller et al. | |
| 2014/0031866 | A1 | 1/2014 | Fuhr et al. | |
| 2015/0005682 | A1 | 1/2015 | Danby et al. | |
| 2015/0107383 | A1 | 4/2015 | Dusselberg et al. | |
| 2017/0027798 | A1 | 2/2017 | Wersland | |
| 2018/0168913 | A1 | 6/2018 | Sedic | |
| 2018/0200141 | A1 | 7/2018 | Wersland et al. | |
| 2019/0091096 | A1 * | 3/2019 | Patel | A61H 23/02 |
| 2019/0254921 | A1 * | 8/2019 | Marton | A61H 23/0254 |
| 2020/0261307 | A1 * | 8/2020 | Wersland | A61H 1/00 |
| 2020/0261310 | A1 * | 8/2020 | Wersland | A61H 1/00 |
| 2020/0352820 | A1 * | 11/2020 | Nazarian | A61H 23/006 |

* cited by examiner

PERCUSSIVE MASSAGE DEVICE WITH SELECTABLE STROKE LENGTH

RELATED APPLICATION

This application claims the benefit of priority under 35 USC § 119(e) of U.S. Provisional Application No. 62/873,731 filed on Jul. 12, 2019, which is incorporated herein by reference in its entirety.

FIELD OF THE INVENTION

The present invention is in the field of therapeutic devices, and, more particularly, is in the field of devices that apply percussive massage to selected portions of a body.

BACKGROUND OF THE INVENTION

Percussive massage, which is also referred to as tapotement, is the rapid, percussive tapping, slapping and cupping of an area of the human body. Percussive massage is used to more aggressively work and strengthen deep-tissue muscles. Percussive massage increases local blood circulation and can even help tone muscle areas. Percussive massage may be applied by a skilled massage therapist using rapid hand movements; however, the manual force applied to the body varies, and the massage therapist may tire before completing a sufficient treatment regime.

Percussive massage may also be applied by electromechanical percussive massage devices (percussive applicators), which are commercially available. Such percussive applicators may include, for example, an electric motor coupled to drive a reciprocating piston within a cylinder. A variety of percussive heads may be attached to the piston to provide different percussive effects on selected areas of the body. Many of the known percussive applicators are expensive, large, relatively heavy, and tethered to an electrical power source. For example, some percussive applicators may require users to grip the applicators with both hands in order to control the applicators. Some percussive applicators are relatively noisy because of the conventional mechanisms used to convert the rotational energy of an electric motor to the reciprocating motion of the piston.

When a percussive massage device is applied to a body of a human, the efficacy of the therapy provided by the percussive massage device depends in part on the length of the stroke of the applicator head. For certain persons or for certain areas on a person's body, a longer stroke length is desirable such that the effect of the applicator head reaches deeply into the muscle tissues. For example, a longer stroke length is often desirable for the larger leg muscles of athletes. For other persons or for other areas of a person's body, a shorter stroke length is desirable such that only a surface portion of the muscle tissues is directly affected by the applicator head. For example, a shorter stroke length is desirable on the lower arms and around the base of the skull. For many persons, a variable stroke length is desirable so that the same percussive massage device can be used on all areas of a person's body.

SUMMARY OF THE INVENTION

A need exists for an electromechanical percussive massage device having a stroke length that can be quickly and easily changed for application to different persons and to different areas of the body of the same person.

One aspect of the embodiments disclosed herein is a percussive massage device that includes a cylinder extending along a longitudinal axis. A motor shaft that rotates about a central axis perpendicular to the longitudinal axis. A crank coupled to the shaft includes a first pivot offset from the central axis. A pinion gear is coupled to the first pivot. The pinion gear rotates within a ring gear. The pinion gear has a second pivot that rotates about the first pivot. A reciprocation linkage is coupled between the second pivot and a piston that moves longitudinally within the cylinder. An applicator head coupled to a second end of the piston has an end exposed outside the cylinder for application to a person receiving treatment. An actuator selectively rotates the ring gear to cause the applicator head to have a first stroke length and at least a second stroke length.

Another aspect in accordance with embodiments disclosed herein is a battery-powered percussive massage device that includes an enclosure having a cylindrical bore, which extends along a longitudinal axis. A piston located within the cylindrical bore has a first end and a second end. The piston is constrained to move only along the longitudinal axis of the cylindrical bore. A motor within the enclosure has a rotatable shaft, which has a central axis perpendicular to the longitudinal axis of the cylindrical bore. A crank coupled to the shaft has a pivot offset from the central axis of the shaft. A gear case coupled to the motor comprises a ring gear having at least a first angular position and a second angular position with respect to the central axis of the shaft. The ring gear has internal gear teeth. A pinion gear has external gear teeth engaged with the internal gear teeth of the ring gear. A central bore of the pinion gear receives the pivot of the crank. The pinion gear has a pinion gear pivot offset from the central bore. An actuator coupled to the ring gear is operable to rotate the ring gear from the first angular position to the second angular position. A reciprocation linkage has a first end and a second end. The first end of the reciprocation linkage is coupled to the pivot of the pinion gear pivot. The second end of the reciprocation linkage coupled to the first end of the piston. An applicator head has a first end and a second end. The first end of the applicator head is coupled to the second end of the piston. The second end of the applicator head is exposed outside the cylindrical bore. The applicator head has a stroke length determined by the angular position of the ring gear. In certain embodiments in accordance with this aspect, the actuator is manually operated.

Another aspect in accordance with embodiments disclosed herein is a method of operating a percussive massage device. The method comprises rotating a shaft of an electric motor to rotate a pivot of a crank about a centerline of the shaft. The method further comprises coupling the pivot of the crank to a pinion gear within a gear casing. The pinion gear has external teeth engaged with internal teeth of a ring gear. The ring gear is rotatable within the gear casing from a first angular position to at least a second angular position. The method further comprises coupling a pivot of the pinion gear to a first end of an interconnection linkage of a reciprocation assembly. The method further comprises coupling a second end of the interconnection linkage to a first end of a piston constrained to move along a longitudinal centerline. The method further comprises coupling a second end of the piston to an applicator head wherein rotational movement of the pivot of the crank causes reciprocating longitudinal movement of the piston and the applicator head. The reciprocating longitudinal movement provides a first stroke length when the ring gear is in the first angular position and provides a second stroke length when the ring gear is in the second angular position.

BRIEF DESCRIPTIONS OF THE DRAWINGS

The foregoing aspects and other aspects of the disclosure are described in detail below in connection with the accompanying drawings in which:

FIG. 1 illustrates a bottom perspective view of a portable electromechanical percussive massage applicator that is battery powered and has a single hand grip, the view in FIG. 1 showing the bottom, the left side and the distal end of the applicator with a removable massage head attached to the applicator;

FIG. 2 illustrates a top perspective view of the portable electromechanical percussive massage applicator of FIG. 1 showing the top, the right side and the proximal end of the applicator, the proximal end having indicator displays and a pushbutton to turn the applicator on and off and to control the operational speed (stroke frequency) of the applicator, the right side having a stroke length adjustment lever to control the stroke length of the removable massage head;

Figure 1:
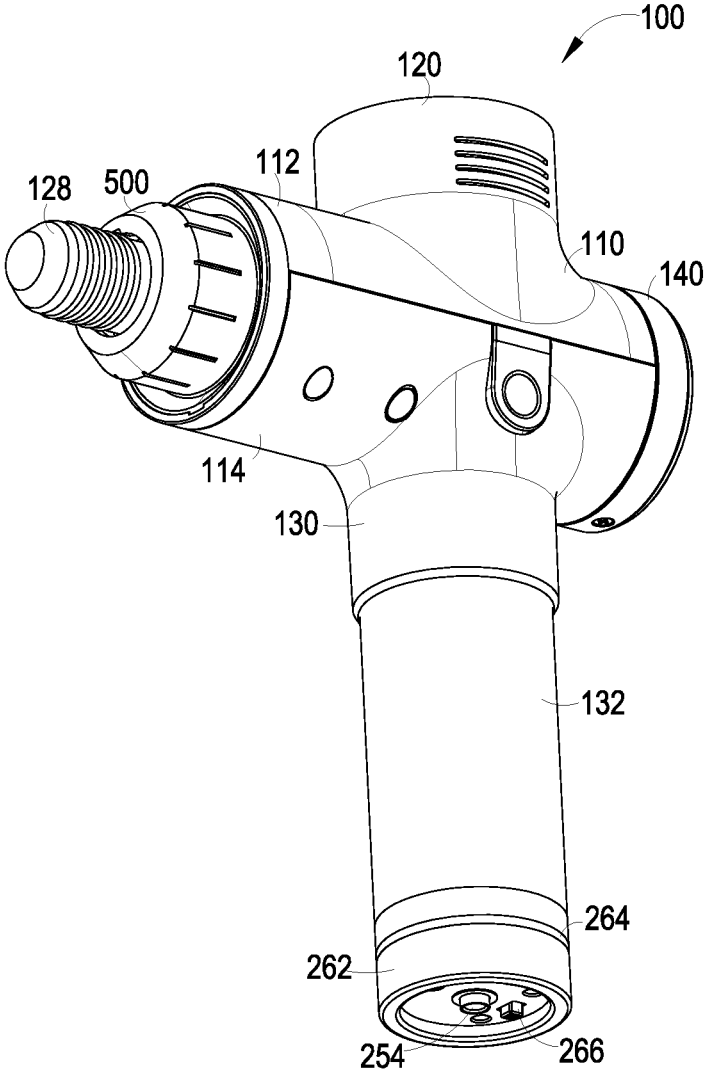
Figure 2:
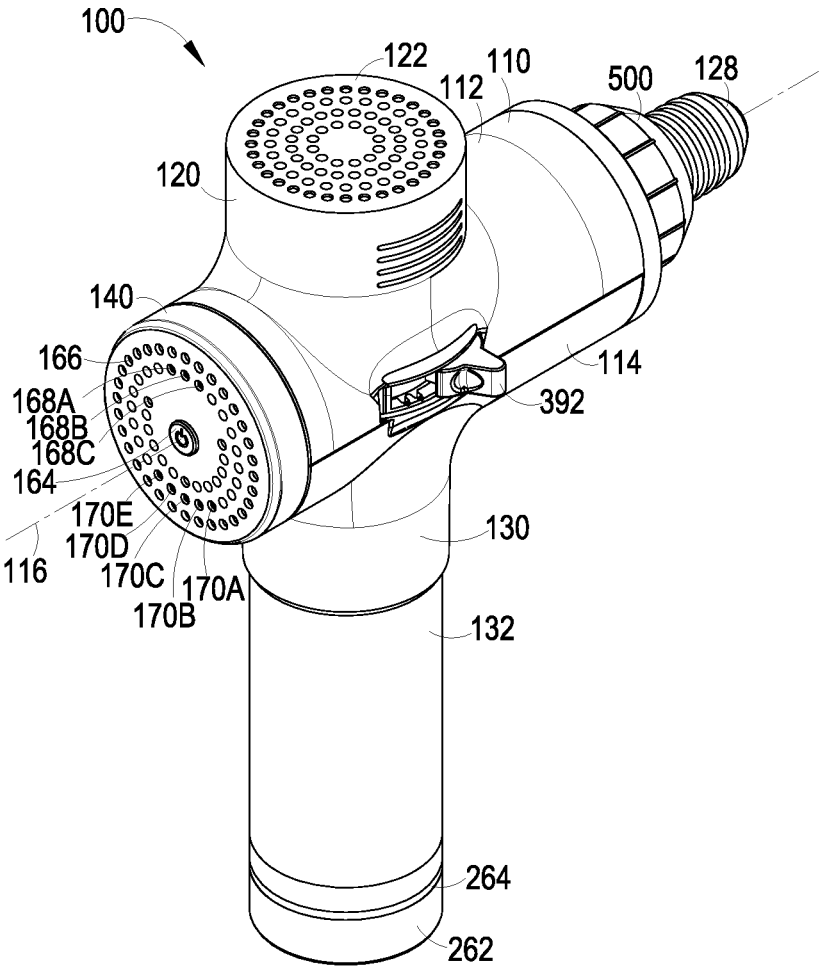
Figure 3:
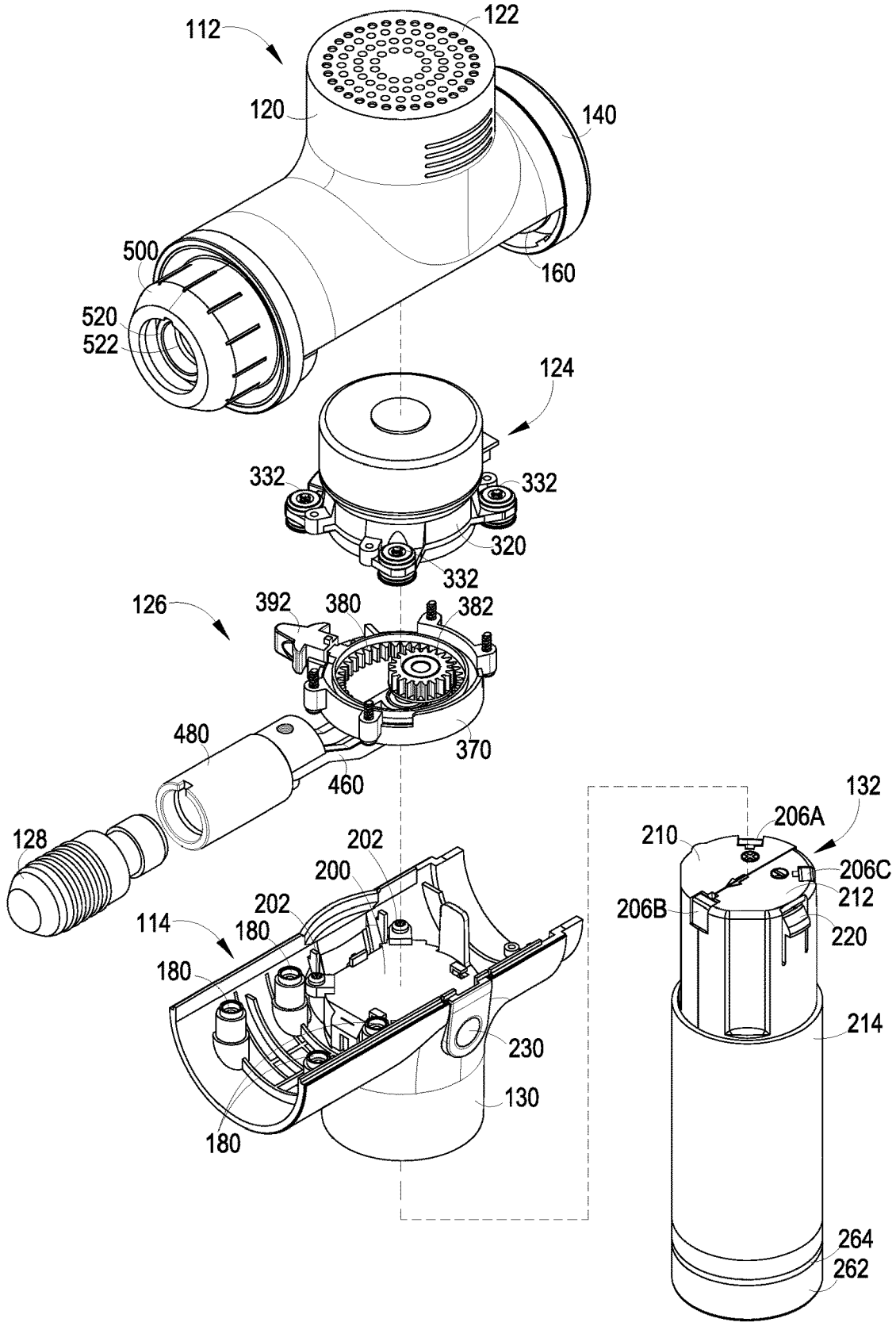
FIG. 3 illustrates an exploded perspective view of the portable electromechanical percussive massage applicator of FIGS. 1 and 2, the view showing the upper housing, a motor assembly, a reciprocation assembly, a lower housing and a removable battery assembly.
Figure 8:
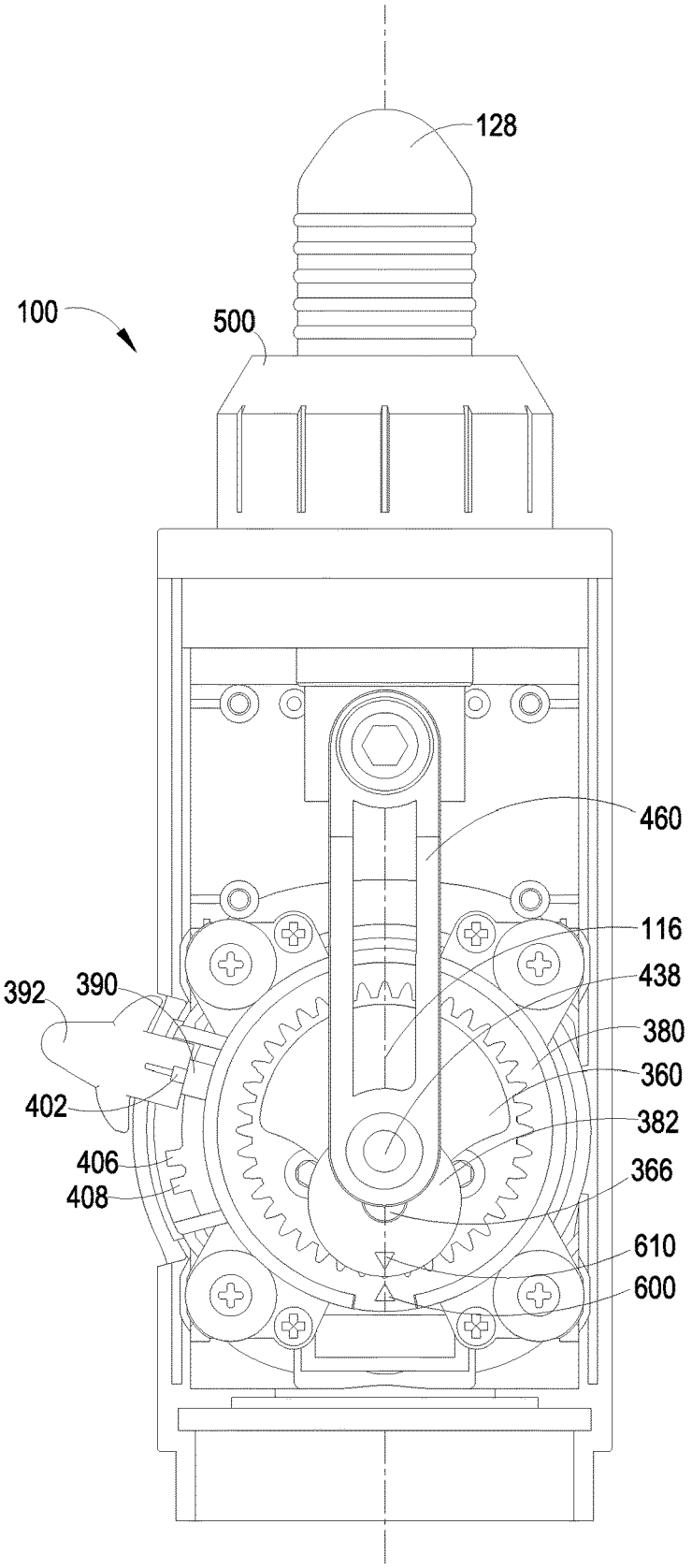
Figure 9:
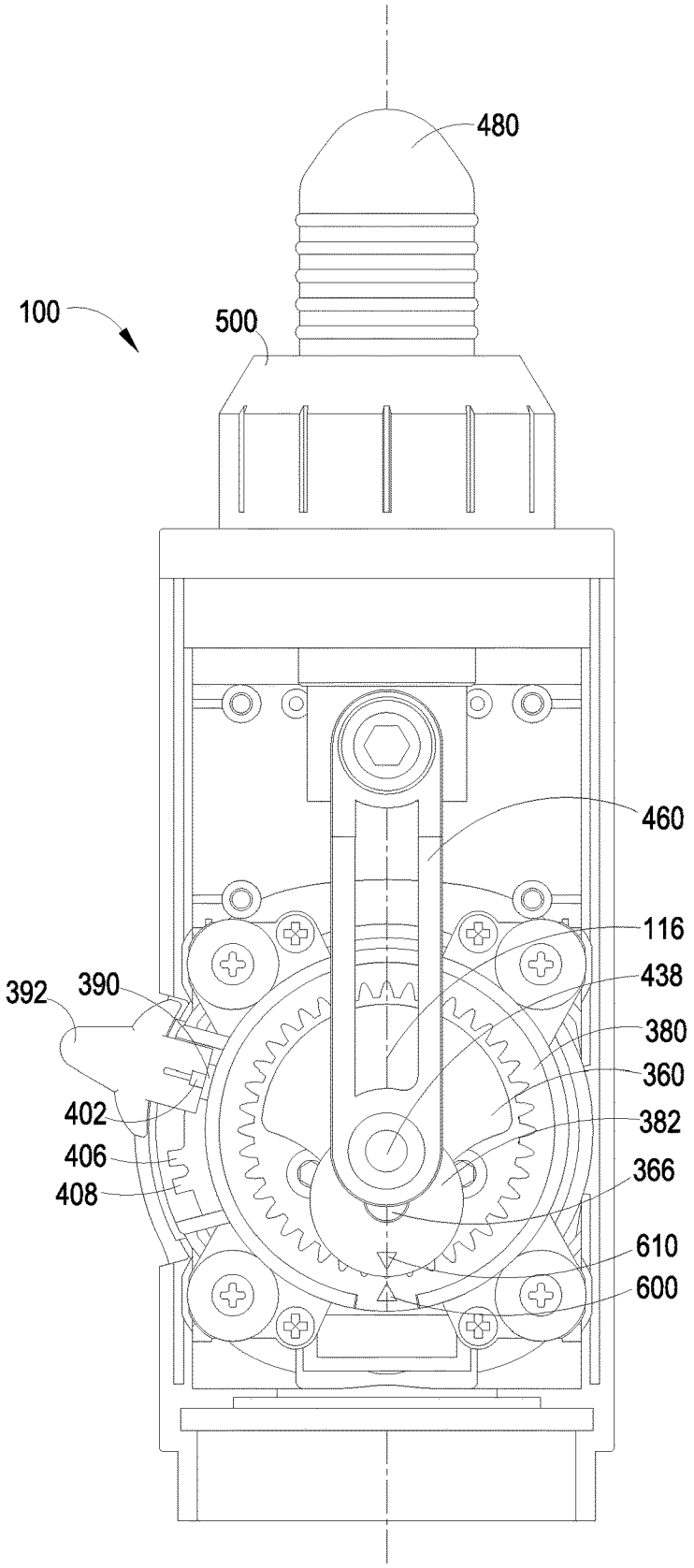
Figure 10:
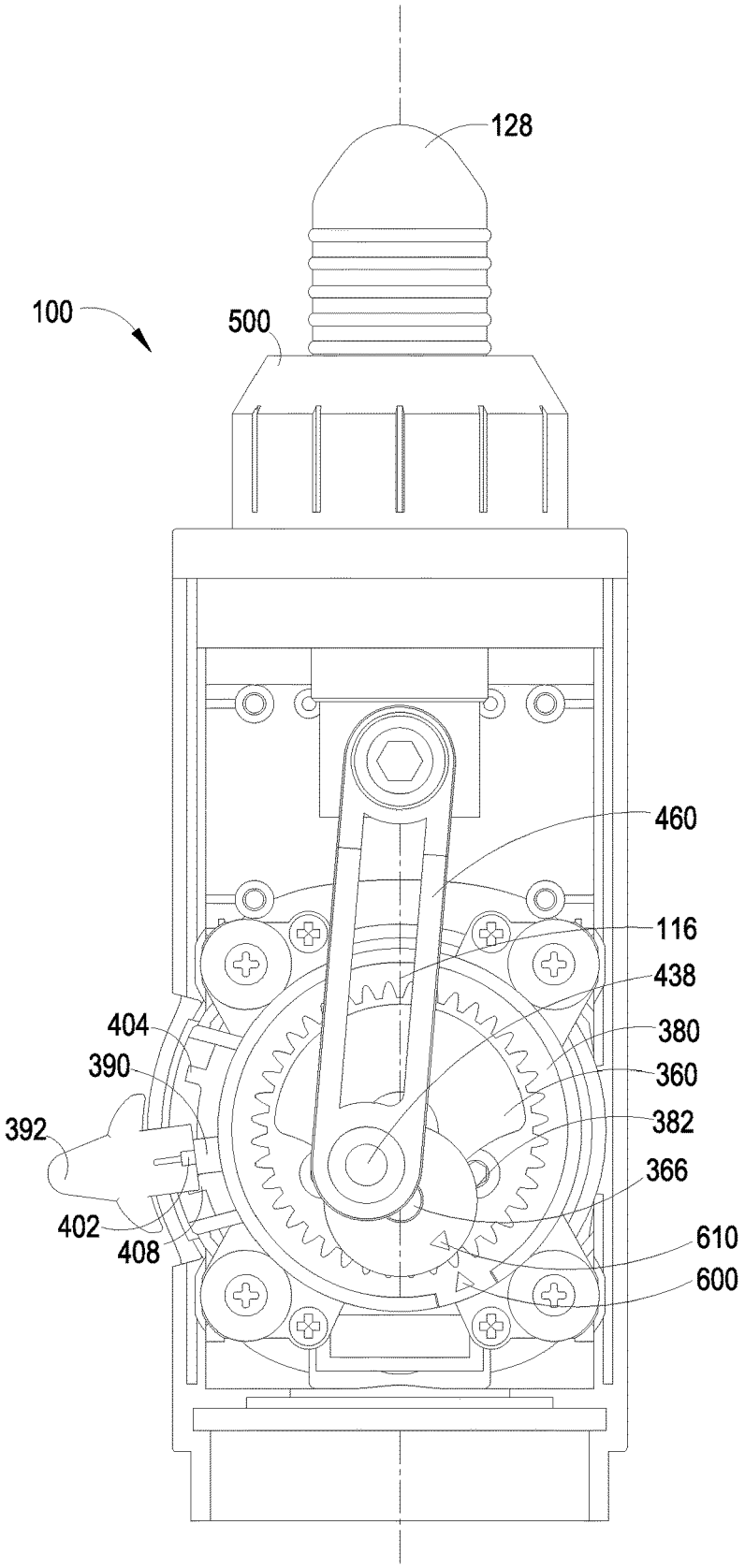
Figure 11:
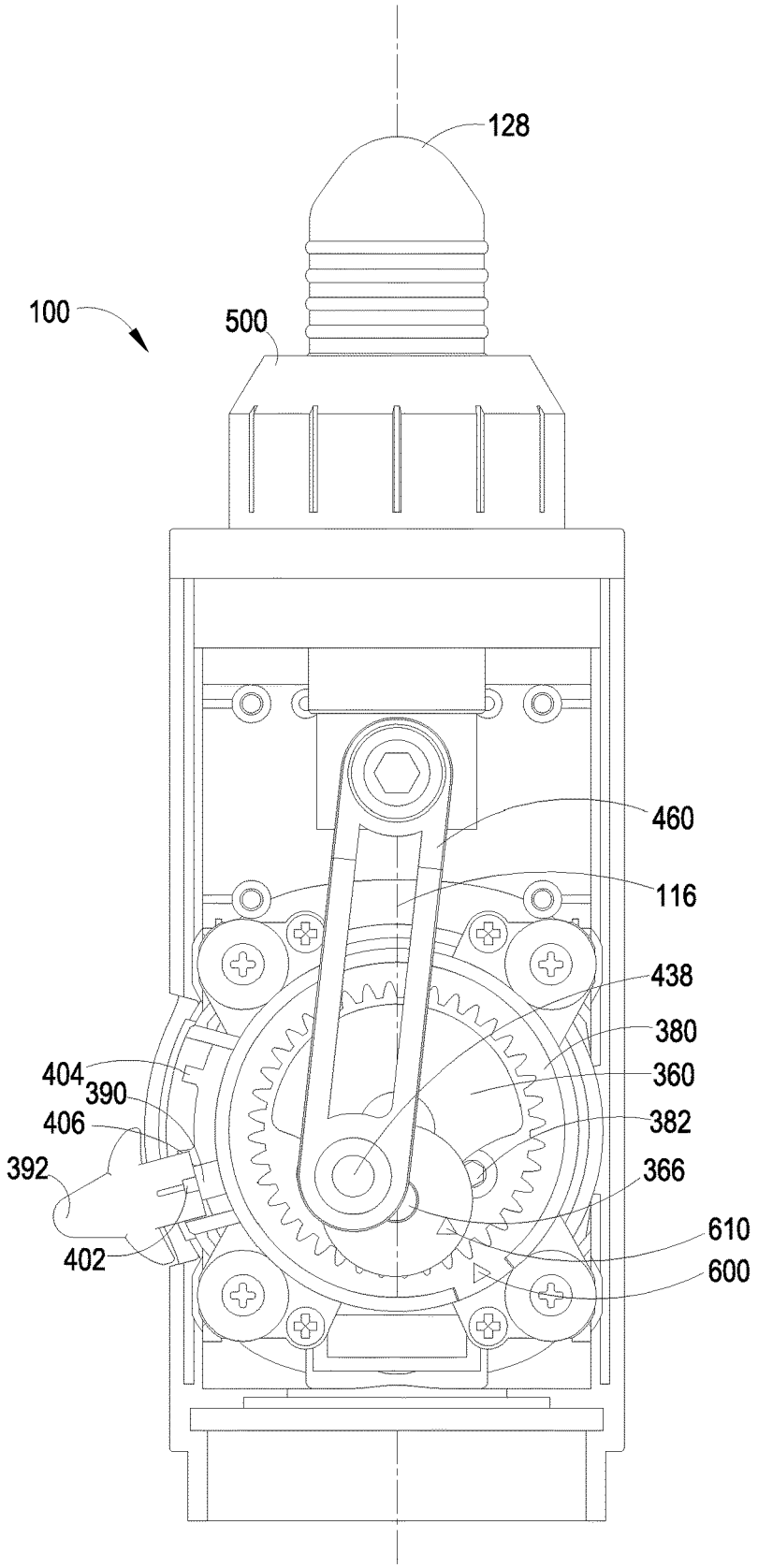
Figure 12:
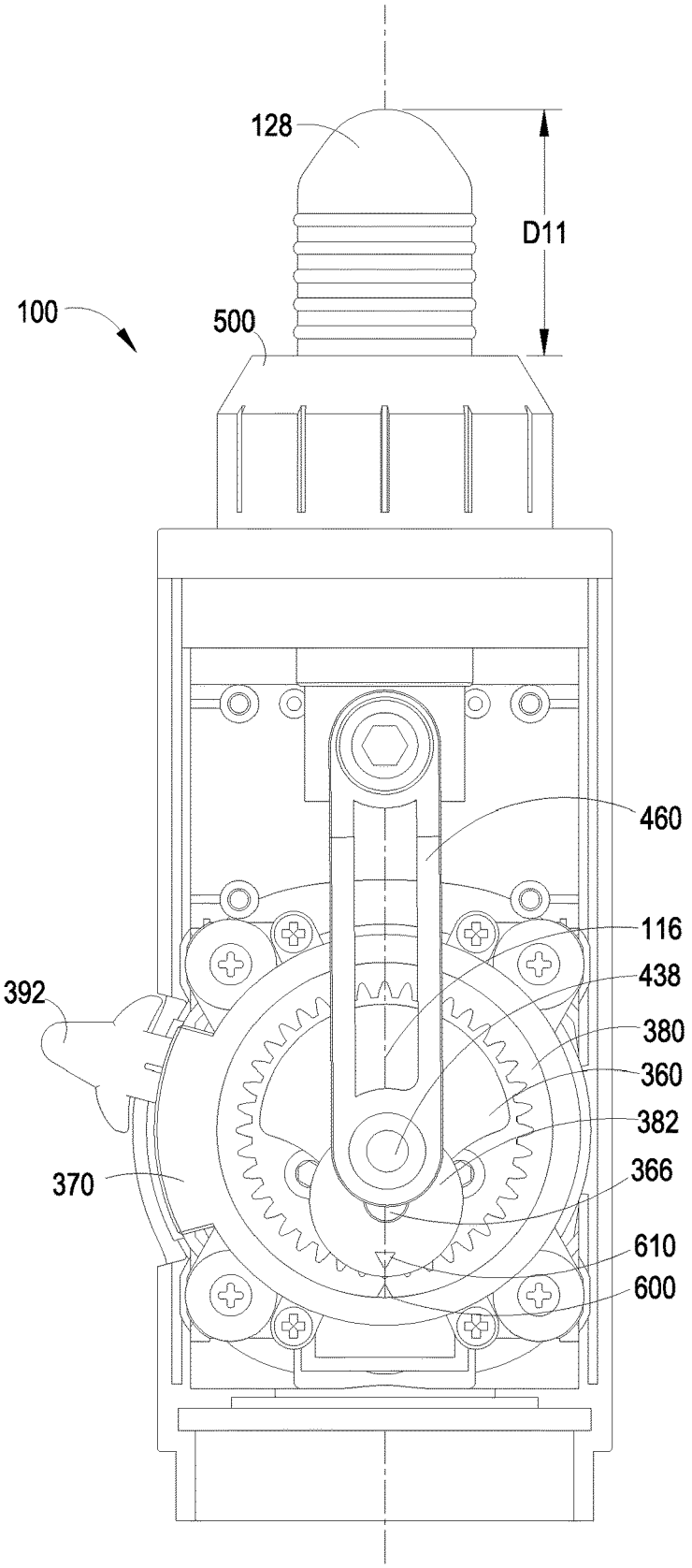
Figure 14:
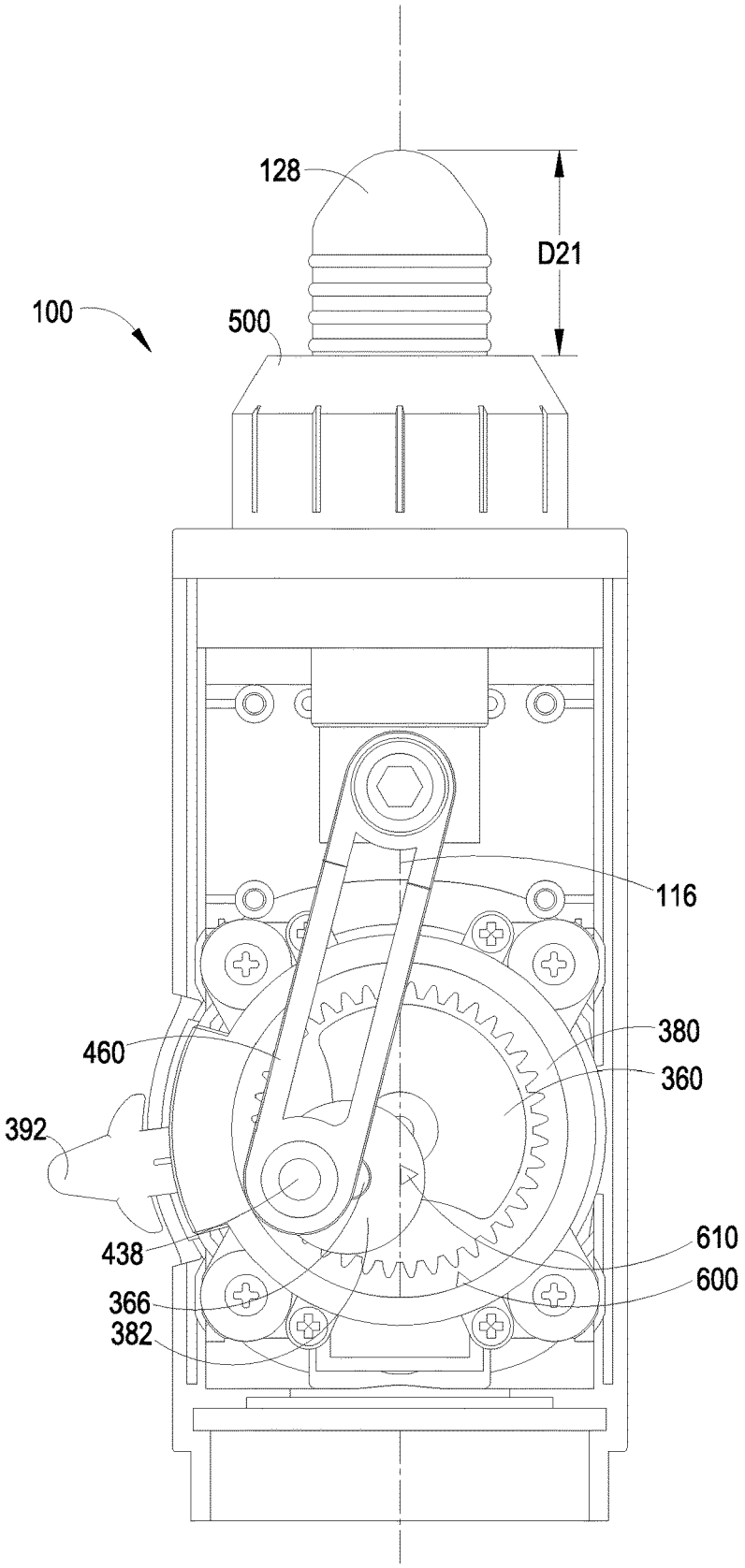
Figure 15:
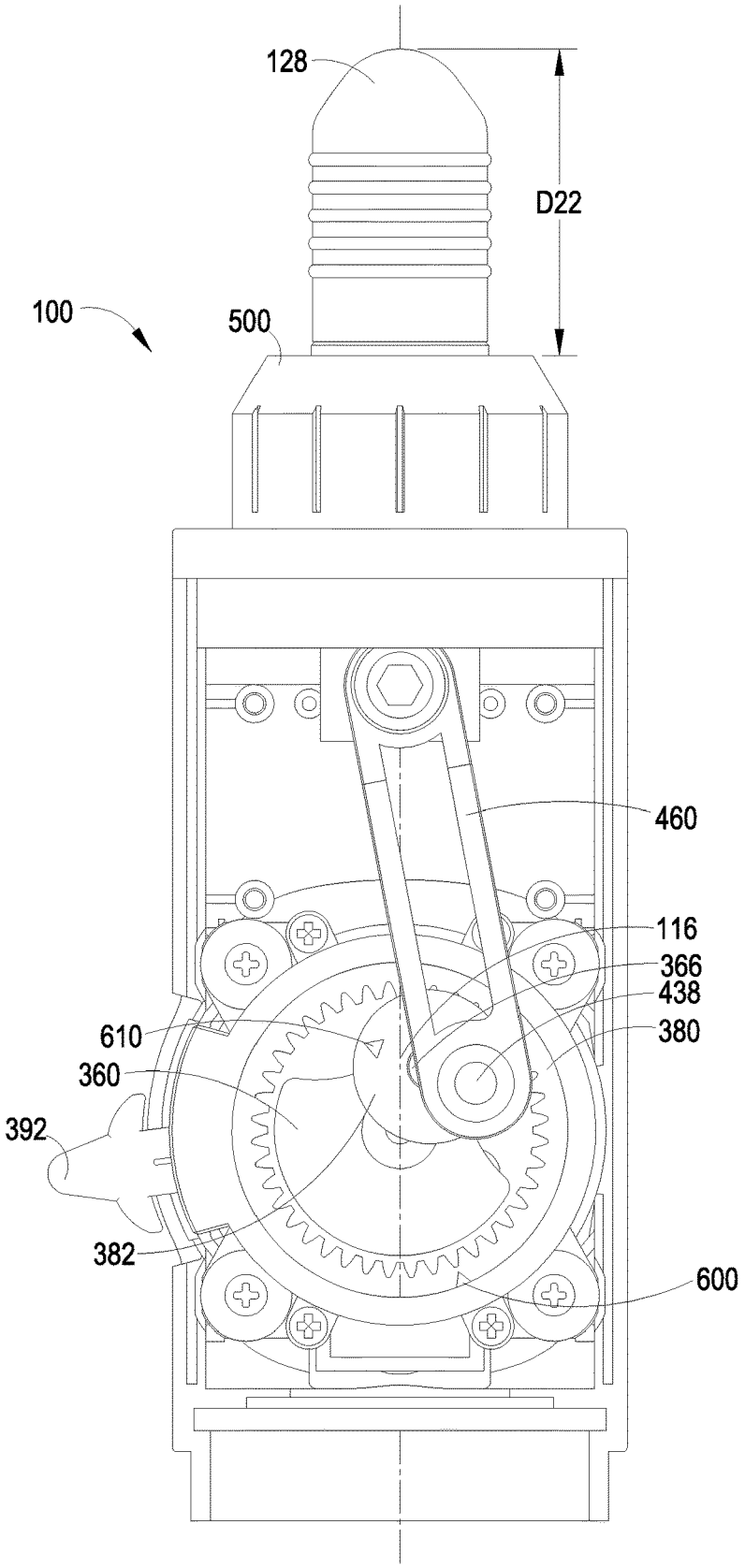
Figure 16:
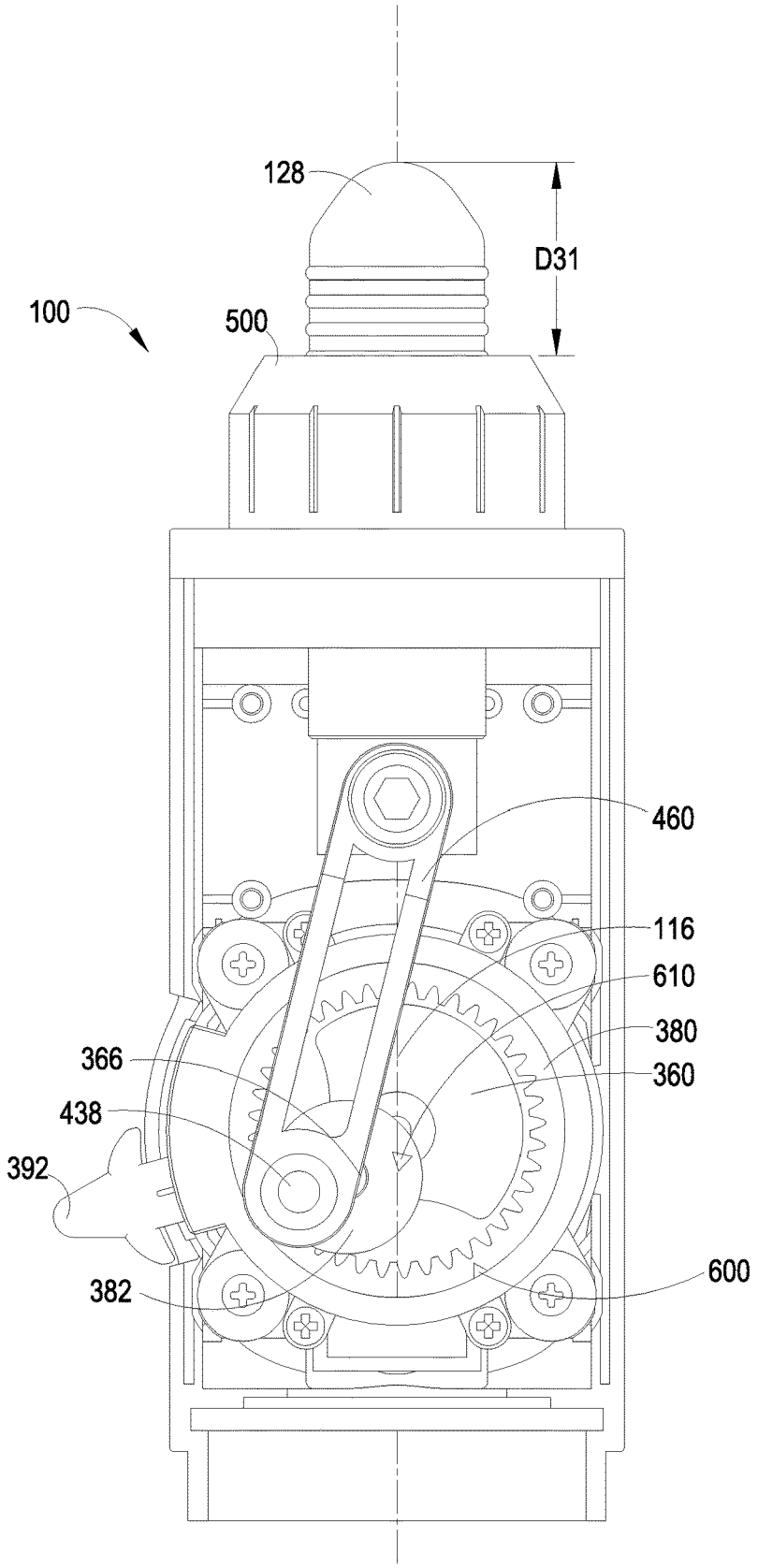
Figure 17:
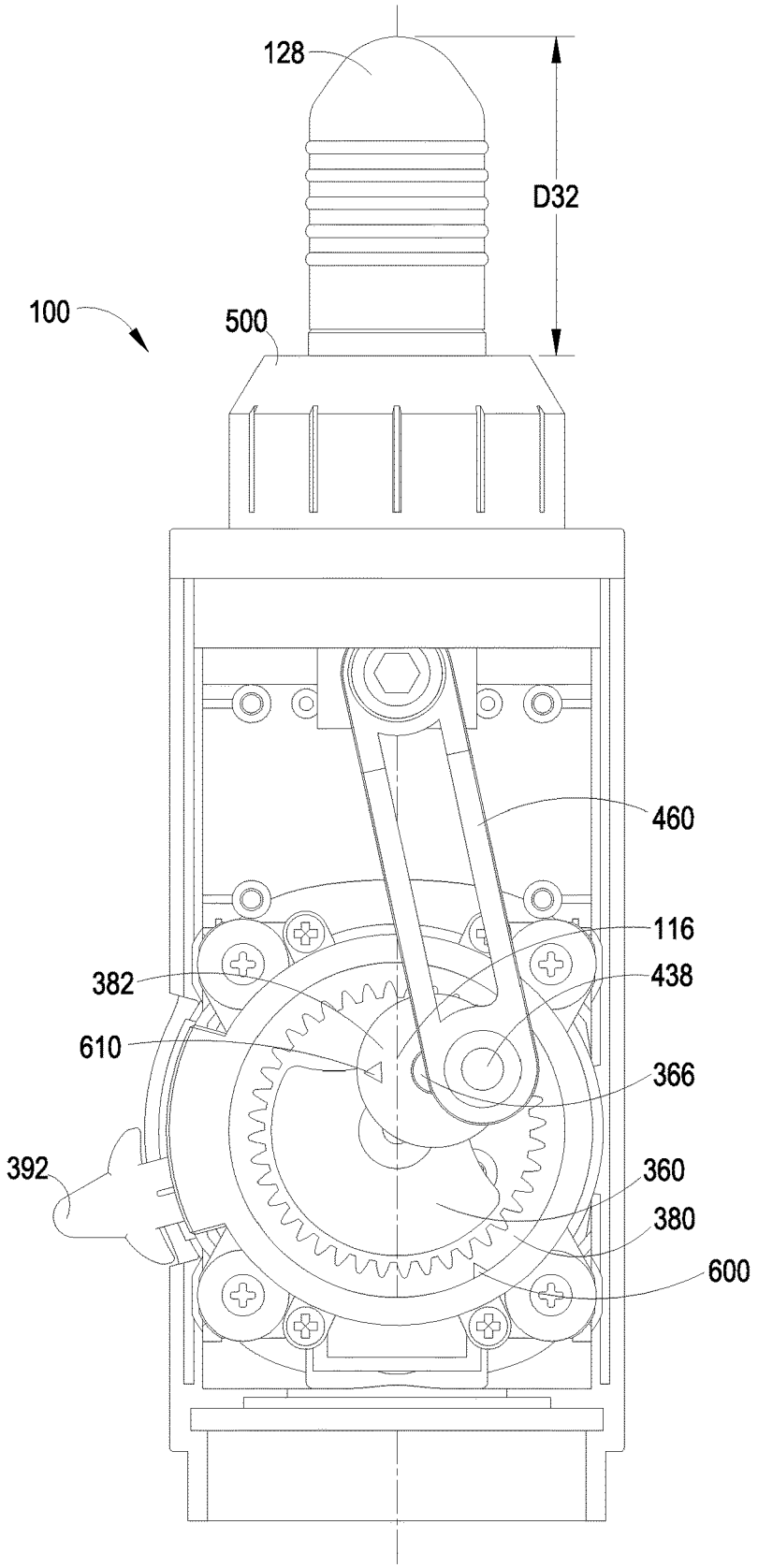

FIG. 8 illustrates a bottom plan view of the upper enclosure of FIGS. 1-3, the view in FIG. 8 having the cover of the gear box removed to show the detail of the stroke selection actuator and the engagement notches that retain the actuator in one of three stroke selection positions, the view in FIG. 8 showing the stroke selection actuator engaged with a first one of the engagement notches to lock the mechanism to provide a first (shortest) stroke length;

FIG. 9 illustrates the bottom plan view of the upper enclosure as shown in FIG. 8, the view in FIG. 9 showing the stroke selection actuator pushed inward to disengage the first one of the engagement notches to allow the stroke selection actuator to be moved with respect to the engagement notches;

FIG. 10 illustrates the bottom plan view of the upper enclosure as shown in FIG. 8, the view in FIG. 10 showing the stroke selection actuator engaged with a second one of the engagement notches to lock the mechanism to provide a second (intermediate) stroke length, the view in FIG. 10 further showing the ring gear rotated 22.5 degrees counterclockwise (as viewed in FIG. 10) with respect to the position of the ring gear in FIG. 8;

FIG. 11 illustrates the bottom plan view of the upper enclosure as shown in FIG. 8, the view in FIG. 11 showing the stroke selection actuator engaged with a third one of the engagement notches to lock the mechanism to provide a third (longest) stroke length, the view in FIG. 11 further showing the ring gear rotated 30 degrees counterclockwise (as viewed in FIG. 11) with respect to the position of the ring gear in FIG. 8;

FIG. 12 illustrates the bottom plan view of FIG. 8 with the gear box cover replaced, the view in FIG. 12 showing the stroke selection actuator in the first position to provide the first (shortest) stroke length, the view in FIG. 12 further showing the tip of the massage head at a first (closest) distance D11 from the distal end of the massage applicator for the first stroke length setting;

FIG. 13 illustrates the bottom plan view of FIG. 13, again showing the stroke selection actuator in the first position to provide the first (shortest) stroke length, the view in FIG. 13 further showing the tip of the massage head at a second (farthest) distance D12 from the distal end of the massage applicator for the first stroke length setting;

FIG. 14 illustrates the bottom plan view of FIG. 8 with the stroke selection actuator in the second position to provide the second (intermediate) stroke length, the view in FIG. 14 further showing the tip of the massage head at a first (closest) distance D21 from the distal end of the massage applicator for the second stroke length setting;

FIG. 15 illustrates the bottom plan view of FIG. 14, again showing the stroke selection actuator in the second position to provide the second (intermediate) stroke length, the view in FIG. 15 further showing the tip of the massage head at a second (farthest) distance D22 from the distal end of the massage applicator for the second stroke length setting;

FIG. 16 illustrates the bottom plan view of FIG. 8 with the stroke selection actuator in the third position to provide the third (longest) stroke length, the view in FIG. 16 further showing the tip of the massage head at a first (closest) distance D31 from the distal end of the massage applicator for the third stroke length setting; and FIG. 17 illustrates the bottom plan view of FIG. 16, again showing the stroke selection actuator in the third position to provide the third (longest) stroke length, the view in FIG. 17 further showing the tip of the massage head at a second (farthest) distance D32 from the distal end of the massage applicator for the third stroke length setting.

DESCRIPTION OF ILLUSTRATED EMBODIMENTS

As used throughout this specification, the words "upper," "lower," "longitudinal," "upward," "downward," "proximal," "distal," and other similar directional words are used with respect to the views being described. It should be understood that the percussive massage applicator described herein can be used in various orientations and is not limited to use in the orientations illustrated in the drawing figures.

A portable electromechanical percussive massage applicator ("percussive massage applicator") 100 is illustrated in FIGS. 1-17. As described below, the percussive massage applicator can be applied to different locations of body to apply percussion to the body to effect percussive treatment. The percussive massage applicator is operable with removably attachable applicator heads to vary the effect of the percussive strokes. The percussive massage applicator operates at a plurality of speeds (e.g., three speeds). The percussive massage applicator can be used by a massage therapist or other person to apply percussive massage to another person. The percussive massage applicator can also be used by the recipient of the massage therapy. The size and weight of the percussive massage applicator along with the cylindrical handle/battery assembly allow the percussive massage applicator to be self-applied to most muscles of a person's body.

The portable electromechanical percussive massage applicator 100 includes a main body 110. The main body includes an upper body portion 112 and a lower body portion 114. The two body portions engage to form a generally cylindrical enclosure about a longitudinal axis 116 (FIG. 2).

A generally cylindrical motor enclosure 120 extends upward from the upper body portion 112. The motor enclosure is substantially perpendicular to the upper body portion. The motor enclosure is capped with a motor enclosure endcap 122, which may be removable in certain embodiments, but which is an integral part of the upper enclosure in the illustrated embodiment. The motor enclosure and the upper body portion house a motor assembly 124 (FIG. 3). The upper body portion also supports a reciprocation assembly 126 (FIG. 3), which is coupled to the motor assembly as described below. The reciprocation assembly drives a removably attachable applicator head 128. The bullet-shaped applicator head shown in FIGS. 1-3 is replaceable with applicator heads having different shapes adaptable to massaging different areas of a body with differing effects.

A generally cylindrical battery assembly receiving enclosure 130 extends downward from the lower body portion 114 and is substantially perpendicular to the lower body portion. A battery assembly 132 extends from the battery assembly receiving enclosure.

A main body endcap 140 is positioned on a proximal end of the main body 110. In addition to other functions described below, the main body endcap also serves as a clamping mechanism to hold the respective proximal ends of the upper body portion 112 and the lower body portion 114 together.

The main body endcap 140 houses a motor controller (main) printed circuit board (PCB) 160. A portion of the motor controller PCB is shown in FIG. 3. The proximal side of the main PCB supports a central pushbutton switch 162 (not shown) which is actuated by a pushbutton actuator 164. The pushbutton actuator extends through the main body endcap as shown in FIG. 2. The pushbutton switch is responsive to manual actuation to turn the motor (described below) on and off and to select one of a plurality of operational speeds for the motor. As shown in FIG. 2, the pushbutton actuator is surrounded on the endcap by a plurality of bores 166, which extend perpendicularly from the outer (proximal) surface of the endcap to form a plurality of concentric rows of bores. Selected ones of the bores are through bores, which allow airflow through the endcap. Three of the bores above the switch have respective speed indication light-emitting diodes (LEDs) 168A, 168B, 168C positioned therein. The three LEDs provide an indication of the operational state of the percussive massage applicator 100 as described in more detail below. Five of the bores located below the pushbutton actuator have respective battery charge state LEDs 170A, 107B, 170C, 170D, 170E positioned therein. The five LEDs provide an indication of the charge state of the battery when the battery assembly 132 is attached and is providing power to the percussive massage applicator.

The upper enclosure 112 and the lower enclosure 114 are interconnected by a plurality of screws (not shown) which pass through a plurality of bores 180 in the lower enclosure and engage corresponding bores (not shown) in the upper enclosure.

As shown in FIG. 3, the lower body portion 114 includes a battery assembly receiving tray 200, which is secured to the inside of the lower body portion in alignment with the battery assembly receiving enclosure 130. The receiving tray is secured to the lower body portion with a plurality of screws 202 (e.g., four screws with only two shown in FIG. 3). The receiving tray includes a plurality of leaf spring contacts (e.g., three contacts not shown), which are positioned in a triangular pattern. The three contacts are positioned to engage a corresponding plurality of contacts 206A, 206B, 206C on the battery assembly 132 when the battery assembly is positioned in the battery assembly receiving enclosure.

The battery assembly 132 comprises six 4.2-volt lithium-ion battery cells connected in series to produce an overall battery voltage of approximately 25.2 volts when fully charged. The battery cells are commercially available from many suppliers, such as, for example, Samsung SDI Co., Ltd., of South Korea. The battery assembly comprises a first battery cover half 210 and a second battery half 212, which snap together. The two halves are further held together by an outer cylindrical cover 214, which also serves as a gripping surface when the percussive massage applicator 100 is being used. In the illustrated embodiment, the outer cover extends only over the portion of the battery assembly that does not enter the battery receiving enclosure 132. In the illustrated embodiment, the outer cover comprises neoprene or another suitable material that combines a cushioning layer with an effective gripping surface.

The upper end of the battery assembly 132 includes at least one mechanical engagement tab 220. When the battery assembly is fully inserted into the battery assembly receiving enclosure 130, the engagement tab engages a portion of the battery assembly receiving enclosure to secure the battery assembly within the battery assembly receiving enclosure.

The lower body portion 114 includes a mechanical button 230 in alignment with the engagement tab 220. When sufficient pressure is applied to the button, the first engagement tab is disengaged from the battery receiving enclosure. Once disengaged, the battery assembly is easily removed from the battery assembly receiving enclosure 130.

The battery assembly 132 includes a printed circuit board (not shown), which supports a battery controller such as the battery controller illustrated in FIG. 23 of U.S. Pat. No. 10,314,762, which is incorporated by reference herein. The battery assembly includes a charging power adapter input jack 254 and an on/off switch (not shown). In the illustrated embodiment, the on/off switch is a slide switch. A switch actuator extender 266 is positioned on the actuator of the slide switch and extends through the endcap to enable the slide switch to be manipulated from the outside of the endcap. The battery controller selectively illuminates a plurality of light-emitting diodes (LEDs) (e.g., six LEDs, not shown). The LEDs are mounted around the periphery of the battery controller PCB. In the illustrated embodiment, each LED is a dual-color LED (e.g., red and green), which may be illuminated to display either color. The battery controller PCB is mounted to a battery assembly endcap 262. A translucent plastic ring 264 is secured to the battery assembly endcap such that the ring is generally aligned with the LEDs. Accordingly, light emitted by the LEDs is emitted through the ring. The color of the LEDs can be used to indicate the charged state of the battery assembly 132. Additional information about the battery controller is provided in the above-identified patent.

Figure 4:
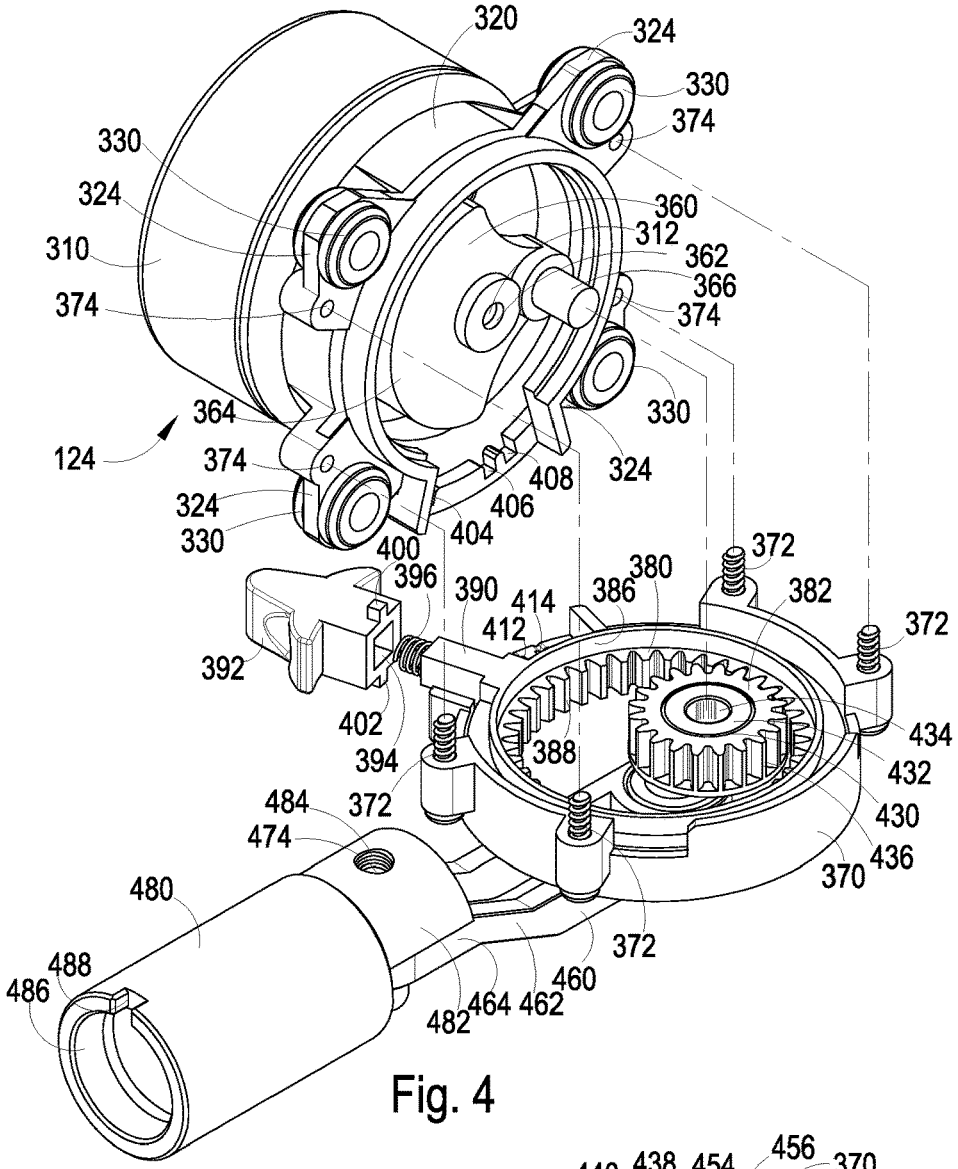
FIG. 4 illustrates a lower perspective view of the motor assembly rotated with respect to the reciprocation assembly with broken lines indicating the interrelationship of the motor assembly and the reciprocation assembly.

As illustrated in FIG. 3, the motor enclosure 120 houses the electric motor assembly 124, which is shown in enlarged detail in FIG. 4. The electric motor assembly includes a brushless DC electric motor 310 having a central shaft 312 that rotates in response to applied electrical energy. In the illustrated embodiment, the electric motor is a 24-volt brushless DC motor. The electric motor may be a commercially available motor. The diameter and height of the motor enclosure and the mounting structures (described below) are adaptable to receive and secure the electric motor within the motor enclosure.

The electric motor 310 is secured to a motor mounting bracket 320 via a plurality of motor mounting screws (not shown). The motor mounting bracket includes a plurality of mounting tabs 324 (e.g., four tabs). Each mounting tab includes a central bore, which receives a respective rubber grommet 330, wherein first and second enlarged portions of the grommet are positioned on opposite surfaces of the tab. A respective bracket mounting screw 332 having an integral washer is passed through a respective central hole in each grommet to engage a respective mounting bore (not shown) n the upper body portion 112. The grommets serve as vibration dampers between the motor mounting bracket and the upper body portion.

The central shaft 312 of the electric motor 310 extends through a central opening 350 in the motor mounting bracket 320. The central shaft engages a central bore 362 of an eccentric crank 360. The central bore is press-fit onto the central shaft of the electric motor or is secured to the shaft by another suitable technique (e.g., using a setscrew). The eccentric crank includes a counterweight portion 364 and a pivot 366. The counterweight and the pivot are positioned 180 degrees apart from each other with respect to the central bore. The pivot is centered at a selected distance (e.g., 10 millimeters in the illustrated embodiment).

As shown in FIG. 4, the motor mounting bracket 320 also functions as a base of a gear casing. The gear casing further includes a gear casing cover 370 that is secured to the base of the gear casing by a plurality of casing screws 372 (e.g., four screws). The casing screws engage a corresponding plurality of threaded bores 374 of the base of the gear casing to attach the gear casing cover to the gear casing base.

The gear casing (gear casing base/motor bracket 320 and gear casing cover 370) enclose a ring gear 380 and a pinion gear 382. The ring gear comprises an annular outer ring 384 that is sized to fit snugly but movably within an inner circumference 386 of the gear casing cover. The ring gear includes a plurality of internal teeth 388. In the illustrated embodiment, the ring gear comprises 40 teeth.

The ring gear 380 further includes a protrusion 390 that extends radially outward from the outer circumference of the annular outer ring 384. In the illustrated embodiment, the protrusion supports a movable stroke adjustment lever 392, which has a central cavity 394 that is sized and shaped to fit snugly but movably over the protrusion. The stroke adjustment lever is biased radially outward from the outer circumference of the annual outer ring by a bias spring 396, which fits within the central cavity.

The stroke adjustment lever 392 further includes an upper peg 400 and a lower peg 402 that are positioned to engage engagement notches on the gear casing base 320 and the gear casing cover 370. In the illustrated embodiment, the gear casing base includes a first notch 404 (shown partially in FIG. 4), a second notch 406 and a third notch 408. The second notch is spaced apart from the first notch by an angular distance of approximately 22.5 degrees in the illustrated embodiment. The third notch is spaced apart from the first notch by an angular distance of approximately 30 degrees in the illustrated embodiment. The angular distances are referenced to the center of the central shaft 312 of the electric motor 310.

The gear casing cover 370 includes a first notch 410 (FIGS. 9-10), a second notch 412 and a third notch 414. The second notch of the gear casing cover is spaced apart from the first notch by 22.5 degrees. The third notch of the gear casing cover is spaced apart from the first notch by approximately 30 degrees. When the gear casing cover is engaged with the gear casing base 320, the first, second and third notches of the gear casing cover are aligned with the respective first, second and third notches 404, 406, 408 of the gear casing base. When the stroke adjustment lever 392 is biased outwardly by the bias spring 396, the upper peg 400 engages one of the notches in the gear casing base, and the lower peg 402 engages a corresponding notch in the gear casing cover. In this condition, the ring gear is fixed in a selected angular position with respect to the gear casing base and the gear casing cover. As described below, when the stroke adjustment lever is pushed inwardly against the bias of the spring, the two pegs disengage from the notches, and the stroke adjustment lever can be used to rotate the ring gear to a new angular position. As further shown in FIG. 5, the lower surface of the stroke adjustment lever includes a semicylindrical protrusion 420 aligned with the lower peg. The semicylindrical protrusion loosely engages a selected one of a first semicylindrical recess 422, a second semicylindrical recess 424 and a third semicylindrical recess 426. The position of the semicylindrical protrusion in alignment with one of the three recesses provides a visual indication to a user that the upper and lower pegs are engaged with a pair of the notches in the gear casing base and the gear casing cover.

Figure 5:
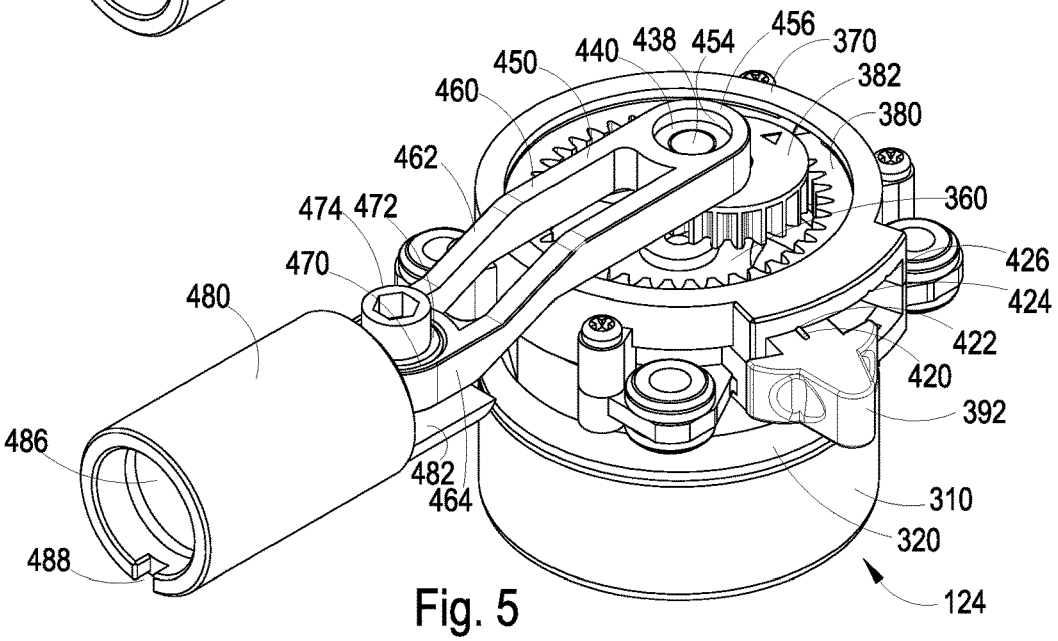
FIG. 5 illustrates the reciprocation assembly of FIG. 4, the reciprocation assembly rotated about a longitudinal axis to show the coupling of the dogleg crank with the offset pivot of the pinion gear, which has outer teeth engaged with the inner teeth of a ring gear.

The pinion gear 382 includes a central bore 430 surrounding a bearing 432. The bearing includes a central bore 434 that engages the pivot 366 of the eccentric crank 360. The pinion gear includes a plurality of external teeth 436 that engage the internal teeth 388 of the ring gear 380. The pinion gear further includes an offset pivot 438 (FIG. 5) that extends from the lower side (as viewed in FIG. 4) of the pinion gear. The offset pivot is spaced apart from the center of the pinion gear by a selected distance (e.g., 7 millimeters in the illustrated embodiment). A bearing 440 is positioned on the offset pivot as shown in FIG. 5.

Figure 6:
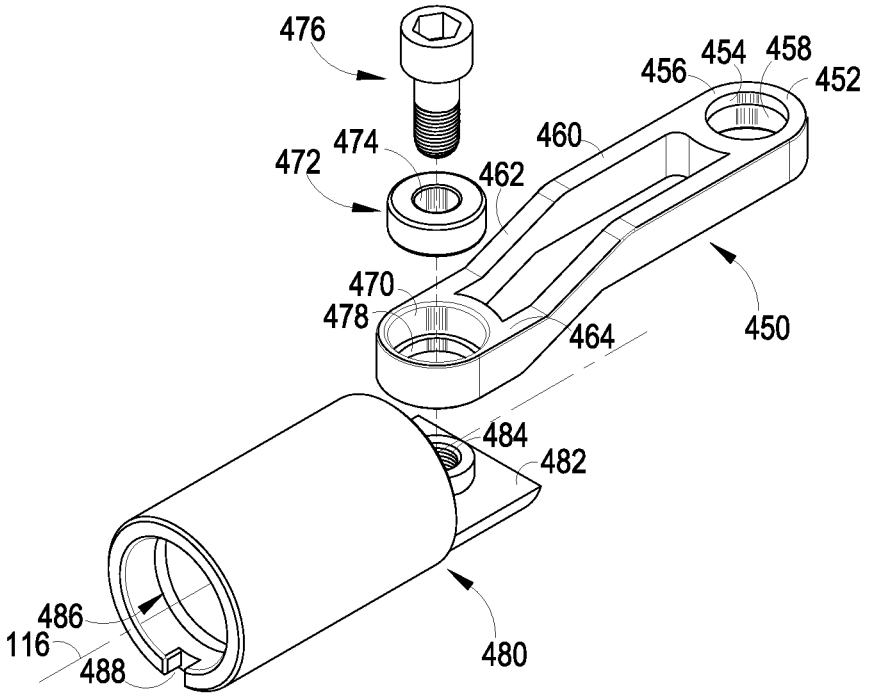
FIG. 6 illustrates an exploded perspective view of the dogleg shaped connector and the piston of the reciprocation assembly of FIG. 3.
Figure 7:
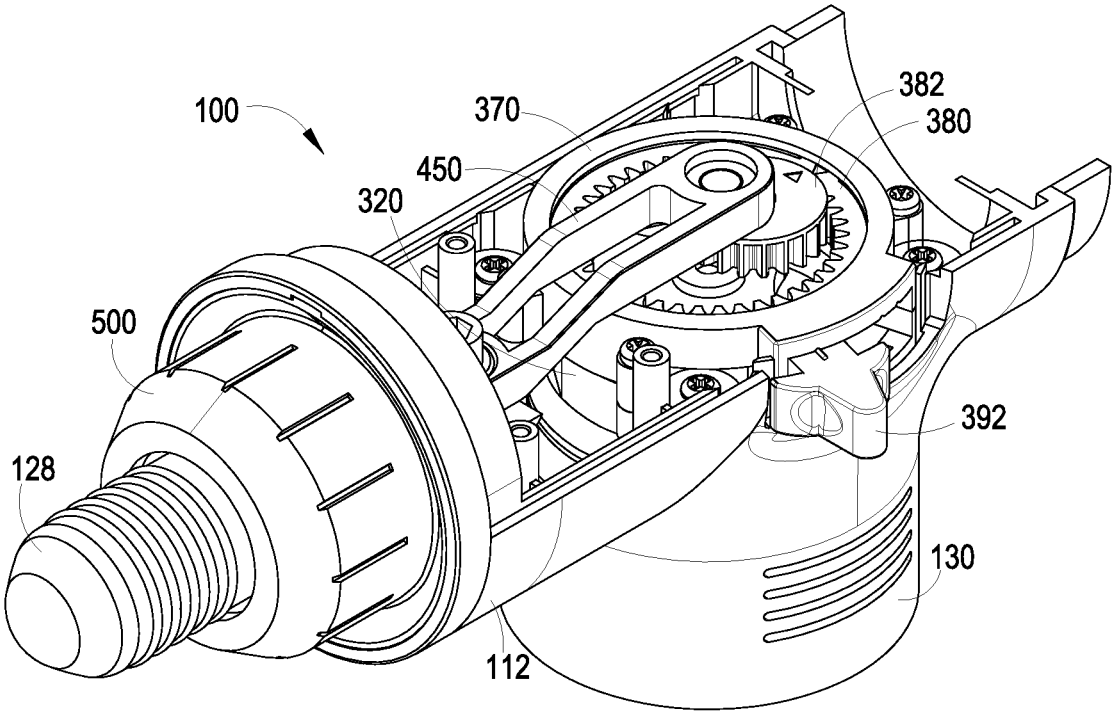
FIG. 7 illustrates a view of the bottom of the upper enclosure in FIGS. 1-3, the view rotated 180 degrees about a longitudinal axis with respect to the view in FIGS. 1-3.

The bearing 440 on the offset pivot 438 of the pinion gear receives a cylindrical bore 454 at a first end 456 of a dogleg-shaped connecting member 450. As illustrated in FIGS. 5 and 6, the connecting member comprises a first longitudinal portion 460 that extends outward from the first end for a first selected distance to a transition portion 462. The first selected distance is chosen such that the first longitudinal portion extends beyond the outer circumference of the gear casing cover 370 when the offset pivot of the pinion gear is positioned a greatest proximal distance from shaft 312 of the motor 310. The transition portion of the connecting member extends at an angle in a direction toward the motor for a second selected distance to a second longitudinal portion 464. The angle and the second selected distance are chosen to cause the second longitudinal portion to be aligned with the longitudinal axis 116 of the percussive massage applicator 100. The second longitudinal portion of the connecting member includes an outer cylindrical bore 470 that receives a bearing 472. The bearing includes a cylindrical bore 474 that receives a cap screw 476. The cap screw extends through the cylindrical bore of the bearing and an inner cylindrical bore (not shown) of the second longitudinal portion and engages a threaded cylindrical bore 484 of a flattened extended portion 482 at a first (proximal) end of a cylindrical piston 480. A second (distal) end of the piston includes a cylindrical bore 486 that receives the applicator head 128. In the illustrated embodiment, the distal end of the piston includes an alignment notch 488 that can be used to align replacement applicator heads that are not symmetrical.

As shown in FIG. 3, the distal end of the upper body portion 112 supports a generally cylindrical outer sleeve 500 having a central bore 502. In the illustrated embodiment, a distal portion 506 proximate to a distal end 504 of the outer sleeve is tapered inward toward the central bore. The outer sleeve has an annular base that is secured to the distal end of the upper body portion by a plurality of screws (e.g., three screws, not shown).

The outer sleeve 500 surrounds a generally cylindrical mounting sleeve 520 that is secured within the outer sleeve when the outer sleeve is secured to the upper body portion 112. The mounting sleeve surrounds a cylinder body 522 that is clamped by the mounting sleeve and is secured in a concentric position with respect to the longitudinal axis 116 of the percussive massage applicator 100. In addition to securing the cylinder body, the mounting sleeve serves as a vibration damper to reduce vibrations propagating from the cylinder body to the main body 110 of the percussive massage applicator.

After installing the reciprocation assembly 126, as described above, the lower body portion 114 is installed by aligning the lower body portion with the upper body portion 112 and securing the two body portions together. The main body endcap 140 is then placed over the proximal ends of the two body portions to further secure the two body portions together.

The battery assembly 132 is installed in the battery assembly receiving enclosure 130 of the lower body portion 114 of the percussive massage applicator 100 and electrically and mechanically engaged as described above. The battery assembly may be charged while installed; or the battery assembly may be charged while removed from the percussive massage applicator.

The operation of the percussive massage applicator 100 is illustrated in FIGS. 8-17, which are views looking up at the motor assembly in the upper body portion 112 with the lower cover 114 and the battery assembly 132 removed.

FIG. 8 illustrates an initial configuration of the reciprocation assembly 126. The stroke adjustment lever 392 is shown in a locked position with the first (upper) peg 400 (FIG. 4) and the second (lower) peg 402 engaging the first pair of notches 404, 410. This initial locked position is referred to herein as the 0-degree position. As indicated by a first arrow 600 on the bottom surface (shown at the top in the view of FIG. 8) of the ring gear 380 and a second arrow 610 on the bottom surface of the pinion gear 382, both gears are in respective 0-degree positions with respect to the longitudinal axis 116. In the 0-degree position, the offset pivot 438 of the pivot gear is also aligned with the longitudinal axis and is at a most proximal location with respect to other positions of the offset pivot as described below.

FIG. 9 illustrates the initial configuration of FIG. 8 with the stroke adjustment lever 392 pushed radially inward to an unlocked position such that the first peg 400 (FIG. 4) and the second peg 402 are disengaged from the first pair of notches 404, 410. The disengagement of the pegs from the notches allows the ring gear 380 to be rotated to other angular positions.

FIG. 10 illustrates the ring gear 380 rotated to the 22.5-degree position as indicated by the ring gear arrow 600. The stroke adjustment lever 392 is shown in the engaged position in FIG. 10. The rotation of the ring gear causes the pinion gear 382 to rotate to a new position as indicated by the pinion gear arrow 610.

FIG. 11 illustrates the ring gear 380 rotated to the 30-degree position as indicated by the ring gear arrow 600. The stroke adjustment lever 392 is shown in the engaged position in FIG. 11. The rotation of the ring gear causes the pinion gear 382 to rotate to a new position as indicated by the pinion gear arrow 610.

Figure 13:
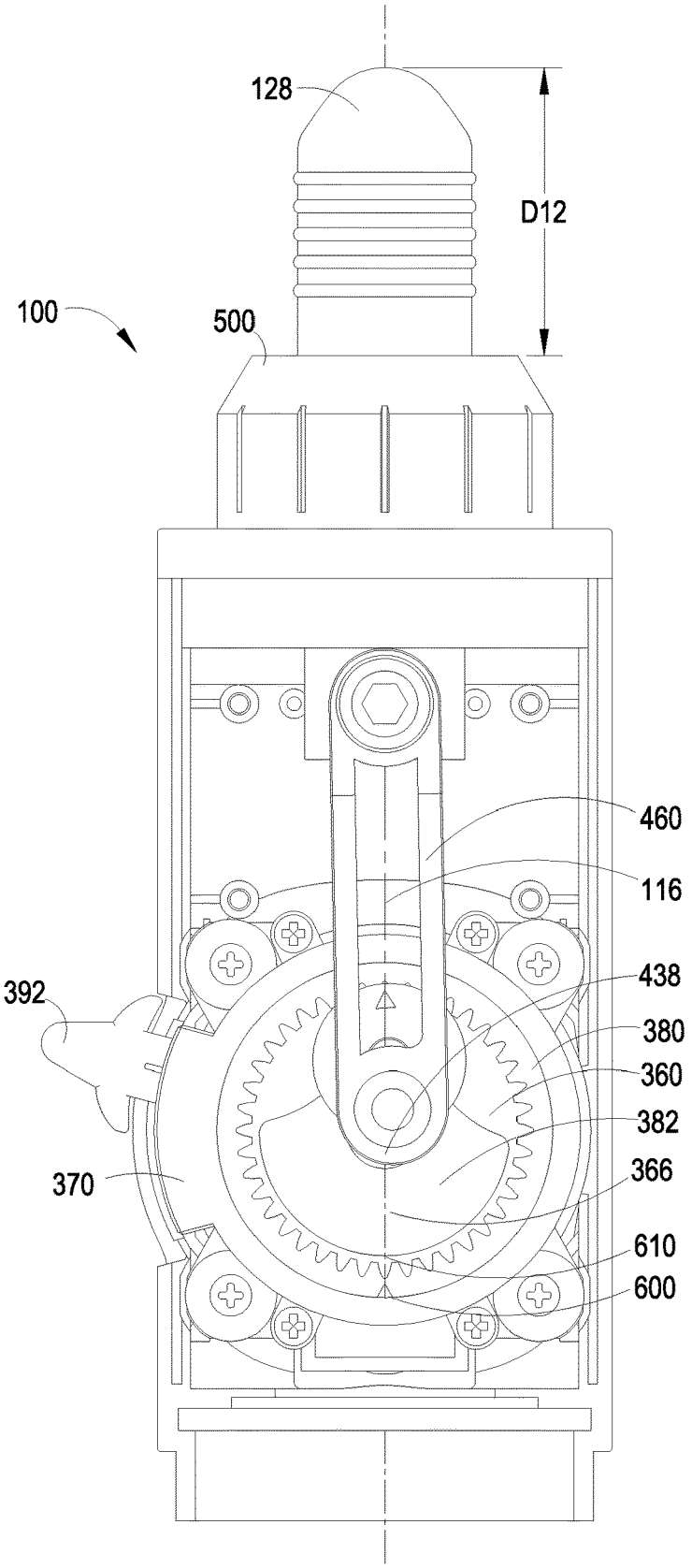

Each angular position of the ring gear 380 causes the reciprocation assembly 126 to move the applicator head 128 by different stroke lengths. FIGS. 12 and 13 illustrate the stroke length when the ring gear is in the initial 0-degree position. In FIG. 12, the ring gear is in the initial 0-degree position and the eccentric crank 360 is positioned such that the indicator arrow 610 of the pinion gear 382 is aligned with the indicator arrow 600 of the ring gear. The offset pivot 438 of the pinion gear is positioned diametrically across from the indicator arrow distal (towards the applicator head 128) to the pivot 366 of the eccentric crank. For the 0-degree angular setting, the position of the offset pivot is the farthest from the applicator head. Accordingly, the tip of the applicator head is shown at a first extended distance D11 from the distal end of the outer sleeve 500.

FIG. 13 illustrates same configuration as FIG. 12 with the ring gear 380 in the initial 0-degree position. In FIG. 13, the eccentric crank 360 has rotated 180 degrees such that the pivot 366 of the eccentric crank is now at a most distal position for the 0-degree configuration. Accordingly, the tip of the applicator head 128 is shown at a distance D12 from the distal end of the outer sleeve 500. The distance D12 is greater than the distance D11. In the illustrated embodiment, the difference between the distance D12 and the distance D11 is approximately 6 millimeters. This distance (D12–D11) is the stroke length of the applicator head when the ring gear is in the 0-degree position. Note that the stroke length is a relative difference between the closest position of the tip of the applicator head with respect to the distal end of the outer sleeve and the farthest position of the tip of the applicator head with respect to the distal end of the outer sleeve. The actual distances from the distal end of the outer sleeve are not relevant to the effect on the body to which the percussive massage device 100 is applied.

FIGS. 14 and 15 illustrate the stroke length when the ring gear is in the second 22.5-degree position. As described above with respect to FIG. 10, the ring gear is in the 22.5-degree position as indicated by the ring gear indicator arrow 600. The pinion gear 382 is in the initial rotated position indicated by the pinion gear indicator arrow 610. Because of the interactions of the rotations of the eccentric crank 360 and the pinion gear, the closest distance and the farthest difference of the tip of the applicator head 128 from the distal end of the outer sleeve 500 are not directly ascertainable from the initial position of the pinion gear. Rather, as shown in FIG. 14, the tip of the applicator head is at a closest distance D21 from the distal end of the outer sleeve when the eccentric crank is offset clockwise from the initial starting position. As shown in FIG. 15, the tip of the applicator head is at a farthest distance D22 from the distal end of the outer sleeve when the eccentric crank is offset counterclockwise from the initial starting position. In the illustrated embodiment, the difference between the distance D22 and the distance D21 is approximately 15.7 millimeters. This distance (D22–D21) is the stroke length of the applicator head when the ring gear is rotated 22.5 degrees.

FIGS. 16 and 17 illustrate the stroke length when the ring gear is in the second 30-degree position. As described above with respect to FIG. 11, the ring gear is in the 30-degree position as indicated by the ring gear indicator arrow 600. The pinion gear 382 is in the initial rotated position indicated by the pinion gear indicator arrow 610. Again, because of the interactions of the rotations of the eccentric crank 360 and the pinion gear, the closest distance and the farthest difference of the tip of the applicator head 128 from the distal end of the outer sleeve 500 are not directly ascertainable from the initial position of the pinion gear. Rather, as shown in FIG. 16, the tip of the applicator head is at a closest distance D31 from the distal end of the outer sleeve when the eccentric crank is offset clockwise from the initial starting position. As shown in FIG. 17, the tip of the applicator head is at a farthest distance D32 from the distal end of the outer sleeve when the eccentric crank is offset counterclockwise from the initial starting position. In the illustrated embodiment, the difference between the distance D32 and the distance D31 is approximately 16.7 millimeters. This distance (D32–D31) is the stroke length of the applicator head when the ring gear is rotated 30 degrees.

Although described above with respect to rotations of the ring gear 380 by 0 degrees, 22.5 degrees and 30 degrees, different rotational degrees can be used in other embodiments. For example, the third position can be increased to a larger angle or a fourth position can be added at a different angle. Although described herein as having three or more stroke lengths determined by the discrete positions of the stroke adjustment lever 392, the percussive massage device 100 can also be continuously adjustable between a first minimum stroke length and a maximum stroke length by providing a frictional engagement between the stroke adjustment lever and the gear casing cover 370. Pushing the stroke adjustment lever radially inward releases the frictional engagement so that the stroke adjustment lever and the ring gear can be rotated to any position between a minimum stroke position and a maximum stroke position. When the stroke adjustment lever returns to the biased position, the ring gear is maintained in the current position and the corresponding stroke length.

The operation of the percussive massage device 100 is described above with respect to the movable stroke adjustment lever 392. In alternative embodiments, the ring gear 380 can be coupled to an electromechanical actuator, such as a motor or a solenoid) to rotate the ring gear from the first angular position to at least a second angular position.

As discussed above, the bullet-shaped applicator head 128 is removably attached to the piston 480. The bullet-shaped applicator head may be disengaged from the piston and replaced with other applicators, which are shown, for example, in U.S. Pat. No. 10,314,762, which is incorporated by reference herein.

The portable electromechanical percussive massage applicator 100 may be provided with power and controlled in a variety of manners. An exemplary battery control circuit is described, for example, with respect to FIG. 23 of the above-identified U.S. Pat. No. 10,314,762. Exemplary motor control circuits are described, for example, with respect to FIG. 24 and FIG. 27 of the same patent.

As various changes could be made in the above constructions without departing from the scope of the invention, it is intended that all the matter contained in the above description or shown in the accompanying drawings shall be interpreted as illustrative and not in a limiting sense.

What is claimed is:

1. A battery-powered percussive massage device comprising:

an enclosure having a cylindrical bore, the cylindrical bore extending along a longitudinal axis;

a piston located within the cylindrical bore, the piston having a first end and a second end, the piston constrained to move only along the longitudinal axis of the cylindrical bore;

a motor positioned within the enclosure, the motor having a rotatable shaft, the shaft having a central axis, the central axis of the shaft perpendicular to the longitudinal axis of the cylindrical bore;

a crank coupled to the shaft, the crank including a pivot, the pivot offset from the central axis of the shaft;

a gear case coupled to the motor, the gear case comprising:

a ring gear having at least a first angular position and a second angular position with respect to the central axis of the shaft, the ring gear having internal gear teeth;

a pinion gear having external gear teeth engaged with the internal gear teeth of the ring gear, the pinion gear having a central bore that receives the pivot of the crank, the pinion gear having a pinion gear pivot offset from the central bore; and an actuator coupled to the ring gear, the actuator operable to rotate the ring gear from the first angular position to the second angular position;

a reciprocation linkage having a first end and a second end, the first end of the reciprocation linkage coupled to the pivot of the pinion gear pivot, the second end of the reciprocation linkage coupled to the first end of the piston; and an applicator head having a first end and a second end, the first end of the applicator head coupled to the second end of the piston, the second end of the applicator head exposed outside the cylindrical bore, the applicator head having a stroke length determined by the angular position of the ring gear.

2. The battery-powered percussive massage device as defined in claim 1, wherein the actuator is manually operated.

3. A method of operating a percussive massage device comprising:

rotating a shaft of an electric motor to rotate a pivot of a crank about a centerline of the shaft;

coupling the pivot of the crank to a pinion gear within a gear casing, the pinion gear having external teeth engaged with internal teeth of a ring gear, the ring gear rotatable within the gear casing from a first angular position to at least a second angular position;

coupling a pivot of the pinion gear to a first end of an interconnection linkage of a reciprocation assembly;

coupling a second end of the interconnection linkage to a first end of a piston constrained to move along a longitudinal centerline;

coupling a second end of the piston to an applicator head wherein rotational movement of the pivot of the crank causes reciprocating longitudinal movement of the piston and the applicator head, the reciprocating longitudinal movement providing a first stroke length when the ring gear is in the first angular position and providing a second stroke length when the ring gear is in the second angular position.

* * * * *